United States Patent [19]

Bode

[11] Patent Number: 4,907,649

[45] Date of Patent: Mar. 13, 1990

[54] RESTRICTION SUBS FOR SETTING CEMENT PLUGS IN WELLS

[76] Inventor: Robert E. Bode, 4545 Louetta Rd., Apt. 2902, Spring, Tex. 77388

[21] Appl. No.: 266,266

[22] Filed: Oct. 26, 1988

Related U.S. Application Data

[63] Continuation of Ser. No. 50,735, May 15, 1987, abandoned.

[51] Int. Cl.[4] ..... E21B 33/05; E21B 23/10; E21B 47/09

[52] U.S. Cl. ..... 166/70; 166/154; 166/242; 166/255; 166/318; 137/553; 137/557

[58] Field of Search ..... 166/153, 154, 70, 193, 166/242, 253, 255, 291, 317, 318; 37/553, 557

[56] References Cited

U.S. PATENT DOCUMENTS

| | | | |
|---|---|---|---|
| 1,791,874 | 2/1931 | Rodgers | 166/70 |
| 2,301,389 | 11/1942 | Farris | 166/291 |
| 3,915,226 | 10/1975 | Savage | 166/153 |
| 4,164,980 | 8/1979 | Duke | 166/70 |
| 4,246,967 | 1/1981 | Harris | 166/153 |
| 4,378,838 | 4/1983 | Ogden et al. | 166/153 |
| 4,427,065 | 1/1984 | Watson | 166/70 |
| 4,510,994 | 4/1985 | Pringle | 166/156 |
| 4,674,573 | 6/1987 | Bode | 166/291 |

*Primary Examiner*—Bruce M. Kisliuk
*Attorney, Agent, or Firm*—Dodge, Bush & Moseley

[57] ABSTRACT

In accordance with illustrative embodiments of the present invention, restriction subs for use in setting cement plugs in wells include a tubular threaded adapter having an internal annular recess, and a metal restriction sleeve mount in such recess. In one embodiment, the sleeve has a corrugation that extends into the bore of the adapter to provide a deformable restriction; in another embodiment the sleeve has curved resilient tabs whose free ends extend into such bore. The restrictions are cooperable with a displacement plug having a metal expander member on its nose so that a distinct pressure is required to cause the expander member and plug to be forced through the restriction.

14 Claims, 2 Drawing Sheets

FIG. 1
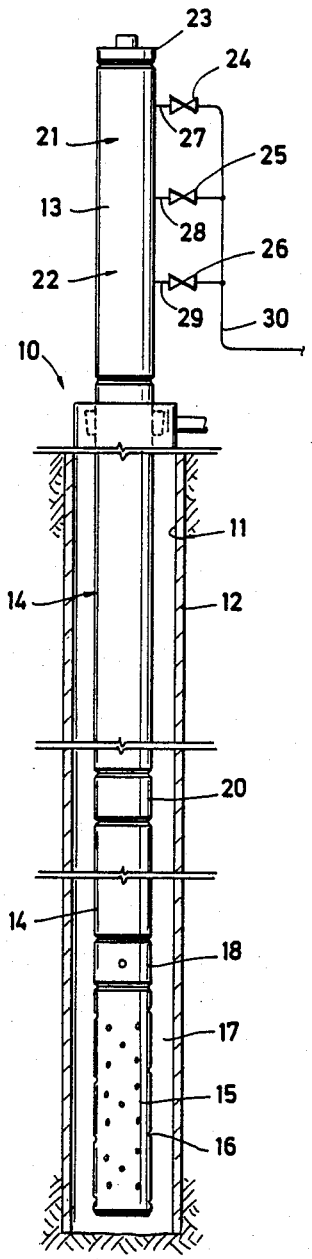
FIG. 2
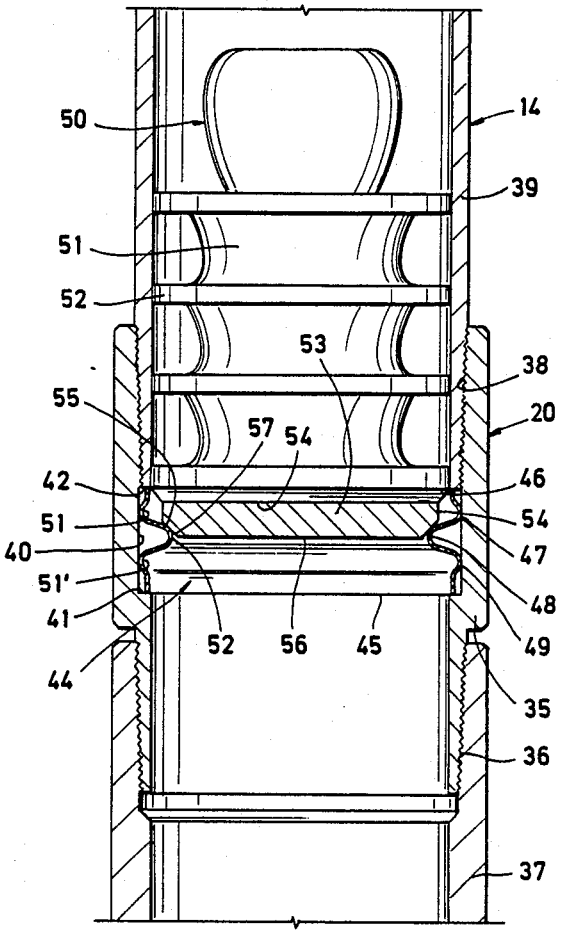
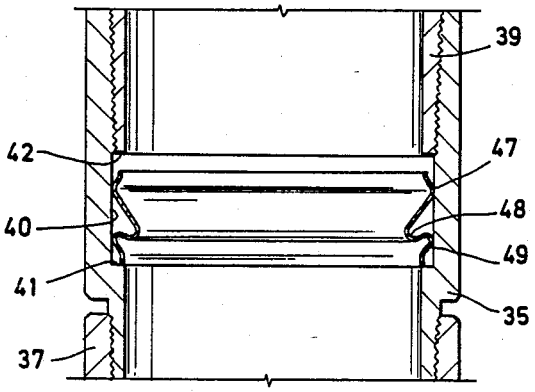
FIG. 3

RESTRICTION SUBS FOR SETTING CEMENT PLUGS IN WELLS

This application is a continuation of application Ser. No. 050,735, filed May 15, 1987, now abandoned.

FIELD OF THE INVENTION

This invention relates generally to plug monitoring systems used in connection with cementing operations in wells, and particularly to new and improved restriction subs that provide surface indications of the precise location of a downhole cement displacement plug.

BACKGROUND OF THE INVENTION

As discussed in detail in my U.S. Application Ser. No. 773,616 filed Sept. 9, 1985 and entitled "Method and Apparatus for Placing Cement Plugs in Wells", now U.S. Pat. No. 4,674,573, issued June 23, 1987, cement plugs are placed in wells for various purposes, for example when a well is to be abandoned, or when a well bore is to be "kicked-off", during drilling, along a different directional path. A known volume of cement slurry is forced down a pipe string by a following displacement fluid, with a plug used as an interface to separate the slurry and displacement fluid. After the slurry has been pumped into the annulus in the region surrounding the lower section of the pipe, the pipe is withdrawn, leaving a column slurry at the bottom of the well bore to set up and harden to form a solid plug that bridges and seals off the well bore.

In order that a sufficient and controlled amount of slurry be used to form a cement plug of a specified height, the typical procedure is to place in the pipe a calculated volume of slurry, and then position a fluid displacement plug (sometimes called a "dart") at the top of the slurry column. A displacement fluid under pressure is then employed to drive the plug downward through the pipe with the slurry ahead of it, until the plug enters a "catcher" sub at the lower end of the pipe string. When this occurs, there will be virtually no slurry left inside the pipe string, which will have been wiped clean of slurry by the plug as it passes downward therein.

Skill is required during the cement plugging operation to know precisely when to stop the pumps so that the displacement plug or dart has reached a known location in the pipe string. Various restriction devices have been used which cause an observable pressure surge to occur at the surface as the plug passes therethrough. One device is constituted by a pipe nipple having a reduced diameter throat section. A pressure increase is noted at the surface when the plug enters the top of the throat section, and when the plug passes out of the bottom of the throat the pressure is reduced. This device can be somewhat expensive to manufacture, and is lengthy. Another known restriction device includes an elastomeric sleeve bonded within an internal recess formed in a tubing. Where water-based drilling muds are used as a displacement fluid, a reliable surface indication is given of the passage of a displacement plug. However, when an oil-based mud is used, the resulting slickness of the sleeve can permit the plug to pass through without any significant increase in pump pressure being observed. The same problem exists when a typical dart-type plug made of an elastomeric material is pumped through a metallic restriction formed by the inner bore of a sub, or by a separate metal sleeve fixed within the bore.

An object of the present invention is to provide a new and improved restriction sub of the type described that enables a distinct surface indication to be given, regardless of the characteristic properties of the displacement fluid being used, or of any other fluids present in the well bore.

SUMMARY OF THE INVENTION

This and other objects are attained in accordance with the concepts of the present invention through the provision of a restriction sub comprising a generally tubular member having an internal recess sized and arranged to receive an annular restriction member through which the displacement plug passes during its downward movement through a pipe string in which the restriction sub is connected. In one embodiment, the annular restriction member is a corrugated metal sleeve, made of aluminum or similar metal, having an inwardly directed undulation that extends a selected distance into the bore of the sub. A metallic nose piece, also preferably made of aluminum, is secured to the leading face of the displacement plug, and has an outer, inwardly inclined frusto-conical surface that engages the undulation on the restrictive sleeve to deform the same and enlarge its initial inner diameter by an amount sufficient to permit the nose piece and plug to pass through it. In another embodiment, the restriction sleeve is formed of tubular spring steel and has at least one pair of diametrically opposed tabs whose free ends are bent inward so as to extend into the inner bore or the sub. In a similar manner, a metallic ring having a downwardly and inwardly sloped outer surface is secured to the nose of the displacement plug, and engages the tabs to cause them to resile outward as the ring passes therethrough. In both cases, since a mechanical deformation or bending of metal is required for passage of the plug, a distinct pressure increase will occur at the surface which is indicative of the passage of the plug, and therefore its precise location in the pipe string which corresponds to the top of the cement slurry column. The indication is not substantially affected by the type of well fluids that may be present.

BRIEF DESCRIPTION OF THE DRAWINGS

The present invention has other objects, features and advantages that will become more clearly apparent in connection with the following detailed description of one or more preferred embodiments, taken in conjunction with the appended drawings in which:

FIG. 1 is a schematic view of a well installation showing a plug launcher, pipe string, restriction sub and plug catcher;

FIG. 2 is a sectional view of one embodiment of a restriction sub of the present invention, having a displacement plug passing downwardly therein;

FIG. 3 is a fragmentary view of the restriction sleeve of FIG. 2 after the plug has passed through;

DETAILED DESCRIPTION OF THE PREFERRED EMBODIMENT

Figure 4:
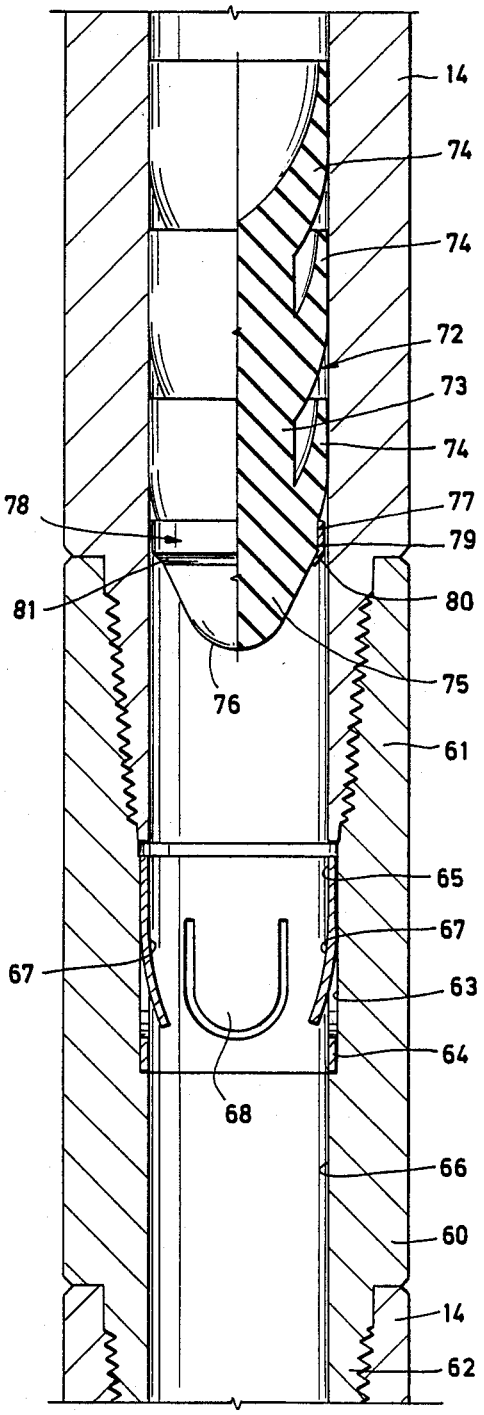
FIG. 4 is a sectional view of another embodiment of a restriction sub in accordance with this invention.

Referring initially to FIG. 1, a well site or installation 10 includes a well bore 11 that may be lined with casing 12, and in which a cement plug is to be placed in order to plug the well bore for abandonment, kick-off, or other purpose. A plug-launcher assembly 13 is connected at the top of the well to a pipe string 14 that has been lowered into the bore 11. A plug catcher assembly 15 and a jet/reverse circulating sub 18 are attached to the bottom end of the string 14, the catcher assembly having exit ports 16 through which cement slurry pumped through the string 14 flows into the annulus 17 and upward around the lower section of the pipe. A restriction sub 20, constructed in accordance with the present invention, is connected in the pipe string 14 a selected distance, for example, 300 feet above the catcher assembly 15.

The plug launching assembly 13 includes upper and lower restrictions at locations referenced 21 and 22, and has a loading cap 23 which is removed to insert plugs into the bore of the assembly. Valves 24–26 in lines 27–29 that communicates with a fluid supply line 30 are provided to permit pumping fluids selectively into a region of the assembly 13 above the upper restriction 21, a region between the restrictions 21 and 22, and a region below the lower restriction 22. The supply line 30 leads to the output of a pump (not shown) so that cement slurry and displacement fluids can be pumped into the upper end of the pipe string 14 under pressure. A pressure gauge (not shown) is placed on the line 30 at a convenient location so that flow pressures, including abrupt changes in such pressures, can be observed by the operator of the pump.

Turning now to FIG. 2, one embodiment of a restriction sub 20 is shown in cross-section. The sub 20 includes a tubular adapter 35 having external threads 36 that connect it to the pipe end 37, and internal threads 38 that connect it to the pipe end 39. The adapter 35 has an internal annular recess 40 formed therein, which provides an upwardly facing shoulder surface 41. The lower end face 42 of the pipe end 39 provides a downwardly facing shoulder, and an annular, corrugated restriction sleeve 44 is mounted partially within the recess 40, with its lower end 45 resting on surface 41 and its upper end 46 located below the shoulder 42. As illustrated, the sleeve 44 has three undulations 47–49, with the inner surfaces 51, 51 of the upper and lower undulations 47, 49 having a somewhat larger inner diameter as the inner diameter of the pipe 14. However the middle undulation 48 has an innermost surface 52 of substantially lesser diameter than the inner diameter of the pipe 14 and thus extends inwardly to provide a substantial restriction in such bore.

The sleeve 44 preferably is made out of material such as aluminum, and has a predetermined sectional wall thickness which provides a selected resistance to deformation.

A displacement plug 50, made of a suitable elastomer material, has a central body 51 and a series of outwardly extending seal flanges 52 that slidably engage the inner wall of the pipe 14 to provide a separation between cement slurry and displacement fluids. A nose plate 53 is secured to the lower end face 54 on the plug 50 by suitable means such as an epoxy adhesive, and has an upper cylindrical wall 54 and a lower frusto-conical wall 55 that inclines downwardly and inwardly. The lower face 56 of the plate 53 can be flat as shown, with the lower edge 57 thereof having a diameter that is somewhat less than the inner diameter of the undulation 48.

As the plug 50 is advanced by fluid pressure down the pipe 14, the inclined surface 58 will encounter the undulation 48 of the sleeve 44, which must be deformed to enable the plug to pass through it. Downward force due to pressure differential across the plug 50 will result in the application of downward and radial forces to the undulation 48, thereby causing it to deform and fold downwardly to the condition shown in FIG. 3, where it has an enlarged inner diameter sufficient to enable the plate 53 and the plug 50 to pass through it. The pressure differential required to cause deformation and enlargement of the inner diameter of the undulation 48 will provide a distinct increase in flow pressure at the surface that can be readily observed on the gauge.

Another embodiment of a restriction sub is shown in FIG. 4. In this embodiment, the tubular adapter 60 has upper and lower threads 61, 62 for connection to the pipe 14, and an internal recess 63 that receives a sleeve 64 made of spring steel. The wall thickness of the sleeve 64 is equal to the radial depth of the recess 63, so that the inner wall 65 of the sleeve is on the same diameter as the inner wall 66 of the adapter 60. Diametrically opposed pairs of U-shaped tabs 67, 68 are formed in the walls of the sleeve 64, and each tab is bent inward on a gentle curvature such that the free ends of the tabs are on a diameter that is substantially smaller than the diameter of the adapter wall 66.

Although the type of displacement plug shown in FIG. 2 could be employed, another type of plug commonly called a "dart" is shown in FIG. 4 immediately prior to passage through the restriction sleeve 64. The dart 72 also is made of an elastomeric material, and has a central body 73 and a plurality of upwardly facing cups 74 that sealingly engage the inner wall of the pipe 14. The lower nose 75 of the dart 72 is generally conical with a rounded lower end surface 76, and the upper end section of the nose has a cylindrical surface 77. Mounted on the surface 77 in a metal ring 78 having a tubular upper portion 79 and an inclined lower portion 80. As the dart 72 is advanced through the restriction sleeve 64, the downward and inward inclined annular surface 81 on the lower portion of the ring 78 engages the tabs 67, 68 and cause them to resile outward to a diameter sufficient to enable the ring 78 to pass through, followed by the seal cups 74.

As in the case of the previous embodiment, the action of the ring 78 in expanding the resilient tabs 67, 68 is mechanical in nature, and is a function of the stiffness of the tabs, which is dependent on their thickness, shape, and other factors. Thus the downward force due to pressure differential across the dart 72 that is required to cause the ring 78 to pass through the tabs 67, 68 is practically independent of the fluid environment, and whether surfaces are lubricated, so that a distinct pressure increase is observed at the surface that is an indication of the precise location of the dart 72, and thus the top or bottom of the cement slurry column.

The restriction sleeve 64 has the added advantage that the tabs 67, 68 return to their original shapes after the dart 72 has passed through, and function to prevent upward movement of the dart in the pipe 14. This feature prevents a "U-tube" effect of cement slurry returning to the bore of the pipe 14 when pumping is stopped.

Figure 5:
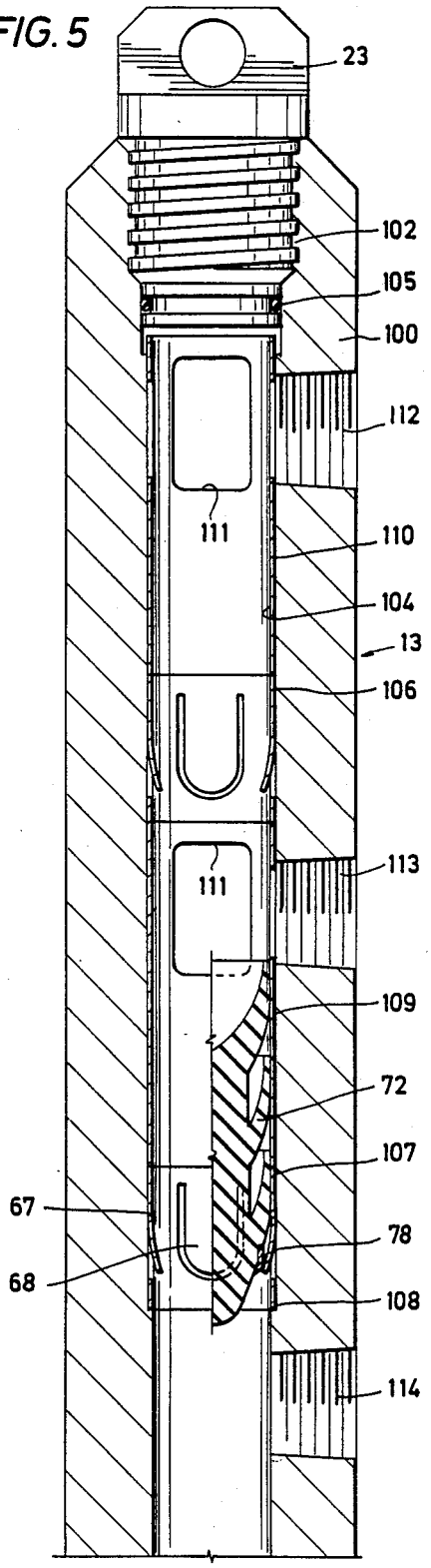
FIG. 5 is a longitudinal sectional view of a plug launching assembly showing a dart-type displacement plug passing through a restriction sleeve of the type shown in FIG. 4.

FIG. 5 illustrates a plug launcher assembly 13 that includes restriction sleeves in accordance with the present invention, for example sleeves constructed as shown in FIG. 4. The launcher assembly 13 includes an elongated tubular body 100 having a thread 101 at its lower end for connection to the upper end of the pipe 14, and an internal thread 102 at its upper end for connecting a cap 103 which can be removed and replaced to enable one or more of the darts 72 to be inserted in the bore 104 of the body 100. A seal ring 105 is provided to prevent fluid leakage past the cap 103. An upper restriction sleeve 106 and a lower restriction sleeve 107 are mounted in the bore of the body 100, the lower sleeve resting on a shoulder 108, and spacer tubes 109, 110 being used to position and mount the upper sleeve 106. Each spacer tube has flow openings 111 at the level of the side ports 112, 113 which communicate with the respective lines 27 and 28 (FIG. 1). A lower side port 114 communicates the bore 104 below the lower restriction sleeve 107 with the line 29.

A first dart 72 is shown prior to being pumped or forced through the lower restriction sleeve 107, and a second dart (not shown) can be loaded into the bore 104 and initially occupy a similar position above the upper restriction sleeve 106. Two darts 72 are used in the event the operator elects to run a cement plug with darts at both the lower and the upper end of the column of slurry.

OPERATION

In operation, the catcher sub 15 and jet/reversing sub 18 are threaded to the lower end of the first pipe joint to be run, and sections or joints of the pipe 14 are coupled end-to-end as the string is lowered into the well bore 11. A restriction sub 20 of the type illustrated in either FIG. 2 or FIG. 4 is connected in the string a selected distance above the catcher assembly 15, for example 300 feet. Generally, the restriction sub 20 is located one or two joints below the proposed top end of the cement plug. The pipe string 14 is lower to bottom (or just off bottom), and the launcher assembly 13 is connected to the upper end of the string by the threads 101. The string 14 then is hung off or suspended in the slips in the rotary. The two displacement plugs or darts 72 are then positioned in the launcher 13, and the cap 103 is secured in the top of the body 100.

A well fluid is then pumped into the pipe string 14 via the port 114 and valve 26 to clean up and condition the well in a typical manner. The bottom dart 72 is then launched by pumping of cement slurry under pressure via the port 113 and valve 25. The dart 72 provides an interface between slurry and well fluids to prevent mixing.

The desired volume of cement slurry is pumped into the pipe 14 which drives the dart 72 downward, after which the upper dart 72' is launched by closing the valve 26 and pumping a displacement fluid into the launcher 13 via the upper port 112 and valve 24. The fact or actual launch of each plug 72 is indicated on the pump pressure gauge as the ring 78 expands the resilient tabs 67, 68. The top plug 72' also provides an interface that prevents contamination of the cement slurry with displacement fluids. As the darts travel downward, they wipe the interior of the pipe 14 clean, leaving substantially no cement on the inner walls of the pipe.

The cement slurry is pumped to within about one barrel of the downhole restriction sub 20, and the pumping rate is reduced to about one barrel per minute. A surface indication is given by a distinct, momentary increase in pump pressure, of the passage on the lower dart 72 through the restriction sleeve. A second indication is given when the upper dart 72' passes through the restriction sleeve, whereupon pumping is stopped immediately. The top of cement slurry in the annulus will be just above the restriction sub 20.

The pipe string 14 is then lifted upward at the surface, by the exemplary amount of 300 feet, while pumping the upper dart 72' downward to empty the pipe string and the catcher sub 15 of slurry. Both darts 72 and 72' will then have entered and been caught in the assembly 15, and the blow-out preventers are closed at the surface. The pipe 14 can be cleaned out by reverse circulation of fluids down the annulus and into the pipe via the sub 18. The column of cement, which will be approximately 300 feet in height, is allowed to harden to form a solid plug in the well bore 11.

If additional cement plugs are desirable, they can be formed on top of the previously set plug using the same procedure described above.

It now will be recognized that new and improved restriction subs useful in cement plugging operations have been disclosed. Since the operation of the restriction subs is due primarily to deformation of a metal member, or members, by another metal element, a very reliable surface indication is given of the exact downhole position of the darts or plugs that define the upper and/or lower ends of the slurry column. Since various changes or modifications may be made in the disclosed embodiments without departing from the inventive concept involved, it is the aim of the following claims to cover all such changes and modifications falling within the true spirit and scope of the present invention.

What is claimed:

1. A restriction sub for use in providing a surface indication of the downhole position of a plug member in a pipe string, comprising: a tubular body having means at its ends for connecting the body in a pipe string, said body having a bore and an internal annular recess, said bore having a first inner diameter and said recess having a second inner diameter, said second inner diameter being larger than said first inner diameter; a circular sleeve mounted in said recess, said sleeve having an inner peripheral surface defined between upper and lower end surfaces, said inner peripheral surface of said sleeve defining an inwardly extending restriction section for providing a yieldable obstruction to the passage of said plug member downward through said bore of said body, said restriction section forming a unitary portion of said sleeve and being located entirely between said upper and lower end surfaces.

2. The sub of claim 1 wherein said restriction section includes at least one corrugation of said sleeve having an inner diameter that initially is smaller than said first inner diameter of said bore.

3. The sub of claim 1 wherein said restriction section comprises at least one resilient tab which forms a portion of a wall of said sleeve, the said tab having a free end portion which extends downwardly and which is curved inward whereby said free end projects into said bore of said body.

4. The sub of claim 1 wherein said restriction section comprises at least one pair of diametrically opposed tabs which form portions of the wall of said sleeve, each of said tabs being curved downward and inward and having a free lower end portion that projects into said bore.

5. The sub of claim 4 where said sleeve and tabs are made of spring steel so that said tabs can be subjected to elastic deformation and return to their original shape.

6. The sub of claim 1 wherein said section has a plurality of corrugations including a restriction corrugation having an inner diameter that initially is smaller than said first inner diameter of said bore.

7. Apparatus for launching plugs into a pipe string during a well cementing operation, comprising an elongated tubular body having a cap releasably secured to its upper end, said body defining an axial bore having a first inner diameter and recess means having a second inner diameter that is larger than said first inner diameter; and spaced upper and lower restriction means mounted in said recess means, each of said restriction means including an annular element formed with yieldable means extending into said bore of said body, said yieldable means being cooperable with a fluid-driven plug to enable passage of said plug therethrough in response to a predetermined fluid pressure.

8. The apparatus of claim 7 wherein said annular element comprises a metallic sleeve having an inwardly directed corrugation, the inner diameter of said corrugation initially being less than the said first inner diameter of said bore.

9. The apparatus of claim 7 where said annular element comprises a sleeve made of a resilient metal and having at least one pair of diametrically opposed tabs forming portions of the wall thereof, each of said tabs having a lower free end and being shaped such that the free ends of said tabs are spaced a distance apart that is smaller than said first inner diameter of said bore.

10. The apparatus of claim 7 further including a cement plug having a longitudinal axis and a lower leading end; expander means on said leading end of said plug having a conical outer surface that is inclined downward and inward with respect to said longitudinal axis of said plug, said inclined surface engaging said yieldable means to force the same outwardly within said said bore to permit said plug to pass downward through said restriction means.

11. The apparatus of claim 8 further including a cement plug having a longitudinal axis and a lower leading end surface; an expander plate secured to said leading end surface of said plug, said plate having a conical outer surface that is inclined downward and inward with respect to said longitudinal axis of said plug, said inclined surface being sized and arranged to engage said corrugation and force enlargement of its said inner diameter by an amount sufficient to pass said expander plate and said plug.

12. The apparatus of claim 9 further including an expander ring secured to said leading end surface of said plug, said ring having a conical outer surface that is inclined downward and inward with respect to said longitudinal axis of said plug, said inclined surface being sized and arranged to engage said tabs and cause them to resile outward to an extent such that said distance is approximately equal to said first inner diameter of said bore to permit passage of said ring and plug through said sleeve.

13. The apparatus of claim 7 further including first port means in said body for feeding fluid under pressure into said bore in a region above said upper restriction means and below said cap; and second port means in said body for feeding fluid under pressure into said bore in a region between said upper and lower restriction means.

14. The apparatus of claim 13 further including third port means in said body for feeding fluid under pressure into said bore in a region below said lower restriction means.

* * * * *